United States Patent [19]

May

[11] 3,959,897

[45] June 1, 1976

[54] COMBINATION VIBRATING CUTTER HEAD AND CRUSHER

[76] Inventor: William P. May, 5601 S. Wayne Ave., Fort Wayne, Ind. 46807

[22] Filed: Dec. 9, 1974

[21] Appl. No.: 530,704

[52] U.S. Cl. ..... 37/58; 37/71; 37/195; 37/DIG. 18; 241/46.13; 241/264; 299/18; 299/67

[51] Int. Cl.[2] ..... E02F 3/92

[58] Field of Search ..... 241/264, 266, 267, 268, 241/269, 265, 46.13; 37/71, DIG. 18, 58, 195; 172/40; 299/8, 9, 18, 37, 67; 302/15; 214/145

[56] References Cited

UNITED STATES PATENTS

| | | | |
|---|---|---|---|
| 413,091 | 10/1889 | Riker | 37/71 X |
| 1,024,664 | 4/1912 | Blatz | 241/264 X |
| 2,566,583 | 9/1951 | Shelton | 241/264 X |
| 2,605,051 | 7/1952 | Bogie | 241/264 X |
| 2,725,799 | 12/1955 | Day et al. | 37/DIG. 18 |
| 2,850,815 | 9/1958 | Edwards | 37/DIG. 18 |
| 3,122,398 | 2/1964 | Tucker | 37/71 X |
| 3,145,488 | 8/1964 | French | 37/DIG. 18 |
| 3,386,669 | 6/1968 | Wood | 241/46.13 |
| 3,613,799 | 10/1971 | Bodine | 37/DIG. 18 |
| 3,628,265 | 12/1971 | Galis | 37/DIG. 18 |

FOREIGN PATENTS OR APPLICATIONS

| | | | |
|---|---|---|---|
| 763,274 | 7/1967 | Canada | 37/DIG. 18 |

*Primary Examiner*—Clifford D. Crowder
*Attorney, Agent, or Firm*—Albert L. Jeffers; Roger M. Rickert

[57] ABSTRACT

A cutter head, or excavating bucket; having a forward edge formed for penetrating earth formations, and which may be in the form of teeth; for earth working operations, especially for dredging operations, and the like, and having a vibrator mechanism associated therewith for enhancing the penetrating action of the forward edge of the cutter into an earth formation. Associated with the cutter is a crushing structure which crushes large boulders taken by the cutter down to smaller sizes. The material taken by the cutter, including the crushed boulders, can be removed from the cutter and crusher by water which is drawn therethrough with he material being delivered to a refuse place or to a further processing station.

14 Claims, 6 Drawing Figures

COMBINATION VIBRATING CUTTER HEAD AND CRUSHER

The present invention relates to equipment for earthworking, especially for dredging operations, or for moving large quantities of earth as in the case of stripping off overburden during mining operations and the like.

When moving earth in large quantities, as occurs when stripping off overburden and also in dredging, not only is it necessary to move large quantities of earth but, many times, rocks and boulders of substantial size are entrained in the earth.

A first problem can be encountered in advancing a digging tool into the earth to be moved and a second problem can be encountered in respect of the rocks and boulders. When the operation being carried out is a dredging operation under water, the material taken during dredging can advantageously be removed from the cutter head by drawing water therethrough, but in this case large boulders and rocks can obstruct the flow of water through the cutter and can also damage the pumping mechanism.

With the foregoing in mind, an object of the present invention is the provision of a cutter head of the nature referred to which incorporates a vibrating mechanism for ease of advancing the cutter head into earth formations.

Another object is the provision of a cutter head for earthworking which incorporates with the cutter head a crushing device for crushing boulders and rocks down to a predetermined size.

A still further object is the provision of a device of the nature referred to above which considerably reduces the cost of carrying out earthworking operations, particularly when the operation is a dredging operation carried out under water.

BRIEF SUMMARY OF THE INVENTION

According to the present invention, a cutter head, which may be somewhat in the form of a drag line bucket or the like, has a base plate adapted for resting on or being disposed near the surface being worked and which base plate has a leading edge in the form of a cutting edge and which may be a series of individual teeth in side by side relation.

Between the leading edge of the base plate and the main portion of the base plate there is a vibrator which causes the toothed leading edge to vibrate thereby enhancing the speed with which it will penetrate earth formations while reducing the force required to advance the edge into the earth.

The aforementioned base plate forms one jaw of a crusher which has a moveable jaw in a position above the base plate and converging therewith in a direction away from the cutting edge. The moveable jaw is adjustable with respect to the minimum gap between the rearward edge of the moveable jaw and the base plate while an eccentric mechanism connected to the forward edge of the moveable jaw is operable for causing the movable jaw to oscillate toward and away from the base plate. The crusher mechanism is operable for crushing rocks and boulders above a predetermined size down to a smaller size.

When the operation being carried out is a dredging operation, a conduit is connected to the rearward end of the cutting head and water is drawn through the conduit and cutting head and, in this manner, the material taken by the cutter head and the broken up rocks and boulders are continuously withdrawn from the cutter head and conveyed to a refuse station or to a place from which the material can be processed further to convert it to fill material or aggregate or to separate sand from the material for further use.

When the operation is being carried out outside the water, as in the case of stripping overburden, then other means are provided for removing the material from the cutter head.

The exact nature of the present invention will become more apparent upon reference to the following detailed specification taken in connection with the accompanying drawings in which.

DETAILED DESCRIPTION OF THE INVENTION

Figure 1:
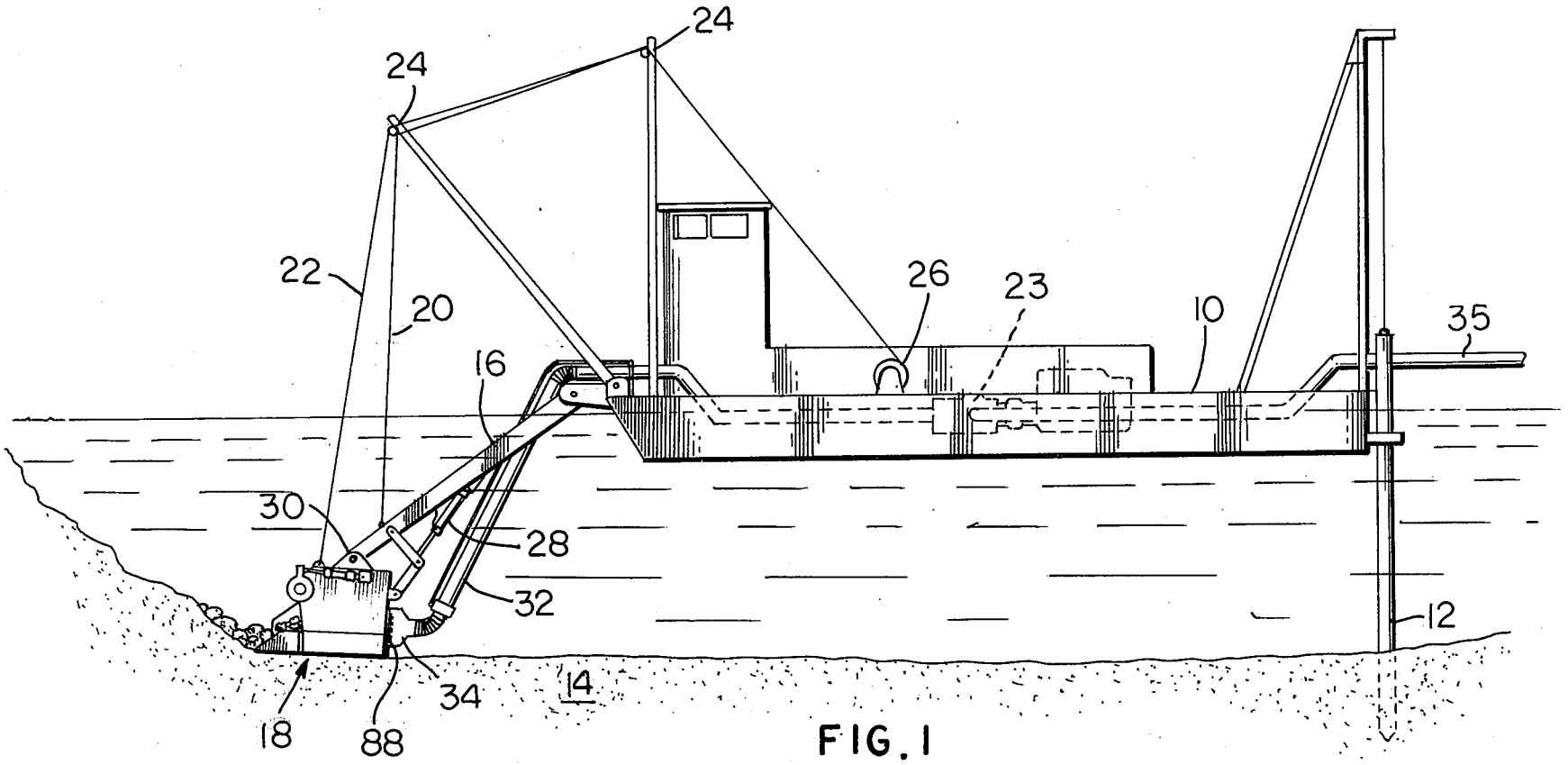
FIG. 1 is a schematic view showing a cutter head arrangement according to the present invention mounted on a barge for carrying out dredging operations.

Referring to the drawings somewhat more in detail, FIG. 1 shows a barge 10 which may be provided at one end with one or more spuds 12 for anchoring the barge to the bottom surface 14 which is being worked. At the end of the barge opposite the spud 12, there is an arm 16 which extends outwardly and downwardly and to which is pivotally connected at the outer end a cutter head according to the present invention and generally designated 18.

Cable means 20 connected to arm 16 cable means and 22 connected to the cutter head pass around suitable boom mounted sheaves 24 to winch means 26 for controlling the adjustment of arm 16 and the cutter head thereon.

The angle of the cutter head relative to arm 16 is, furthermore, under the control of lift cylinder means 28 connected between the arm and cutting head and operable to tilt the cutting head about pivotal connection 30 thereof with the outer end of arm 16.

A large conduit 32 is connected at the lower end as at 34 to the rearward end of cutting device 18 and extends upwardly to suitable pumping mechanism 23 carried by the barge for withdrawing material from the cutting head. Advantageously, the discharge side of the pump is connected by conduit 35 with a place of refuse disposal. The pump may, of course, be shore mounted and connected to conduit 35 if so desired.

Figure 2:
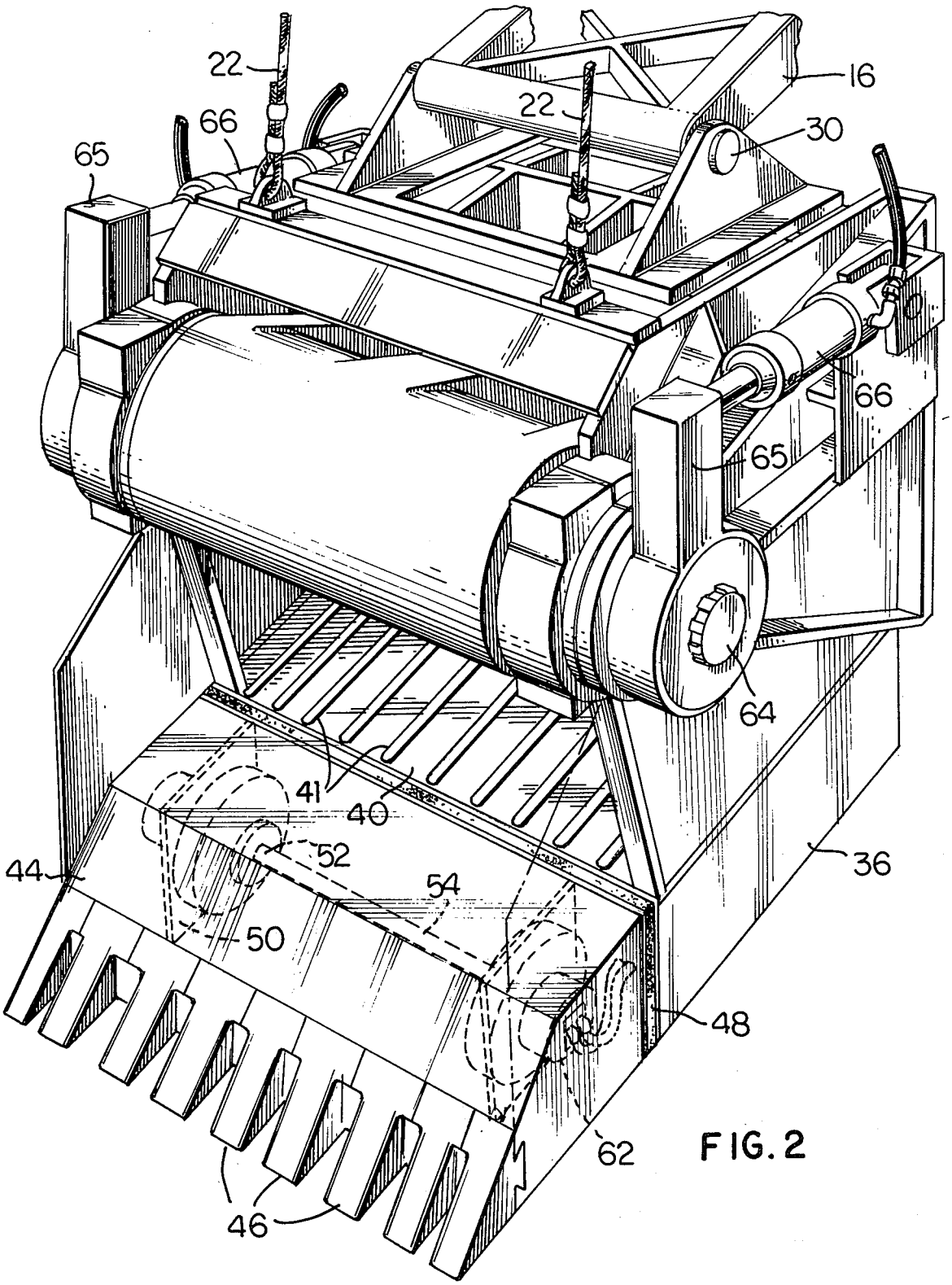
FIG. 2 is a perspective view showing the cutter head and crusher.
Figure 3:
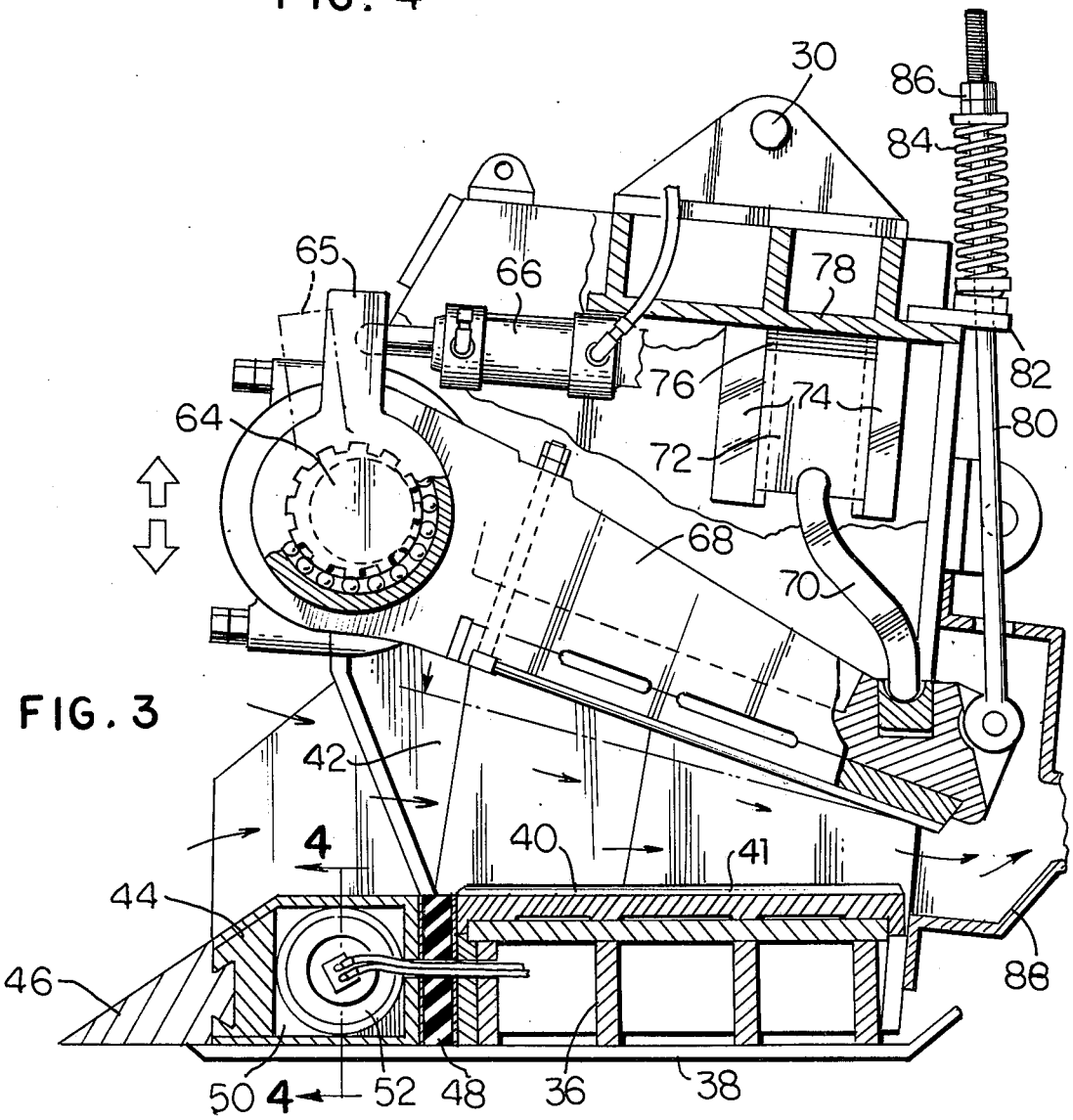
FIG. 3 is a longitudinal section through the cutter head and crusher showing the essential parts thereof.

The cutter head is shown in perspective view in FIG. 2 and in sectional view in FIG. 3.

The cutter head comprises a main base plate portion 36 which may be a weldment having skids 38 on the bottom and having mounted on the top the lower jaw 40 of a crushing mechanism. Jaw 40 is preferably a fairly hard or tough material, such as manganese bearing steel, and may include longitudinal ribs thereon.

Connected with base plate 36 are side plates 42 which upstand from the base plate and which define therebetween the inside of the cutting head.

Figure 4:
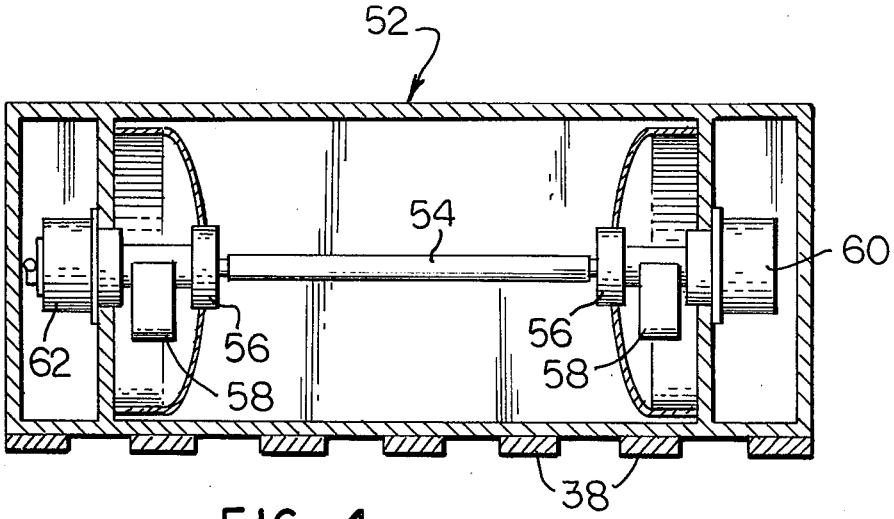
FIG. 4 is a section indicated by line 4—4 on FIG. 3 showing a devibrator mechanism associated with the cutting edge of the cutter head.

At the left end of base plate 36 as it is viewed in FIG. 3, there is a cutting edge member 44 which may comprise a plurality of hard teeth 46 arranged in side by side relation and tapering downwardly toward the left. The cutting edge member is mounted on the base plate 36 with a cushion member 48 of rubber-like material disposed therebetween so that the edge member can be vibrated relative to the base plate. The edge member includes a compartment 50 within which a vibrator mechanism 52 is disposed and which vibrator member is driven by a hydraulic motor and causes the cutting edge of the base plate to vibrate. The vibrator 52 is illustrated more in detail in FIG. 4, wherein it will be seen to comprise a shaft 54 journaled in bearings 56 and having off center weights 58 on the shaft near the outer ends.

Shaft 54 has a further bearing 60 at one end and at the other end has a rotary hydraulic drive motor 62 and which, itself, serves as a bearing for the opposite end. The weights 58 are, thus, disposed between supporting bearings and rotation of shaft 54 by hydraulic motor 62 will efficiently transmit vibrations into the cutting edge of the cutting head.

Between the side plates 42 near the forward edge thereof is an eccentric shaft 64 with means in the form of a fluid motor 66 for oscillating the shaft. On eccentric regions along the shaft, there is journaled the top crusher jaw 68 so that as shaft 64 is oscillated, the left, or forward, end of upper jaw 68 will move up and down in the cutter head as indicated by the dashed outline of the cutter head in its lower position in FIG. 3.

The upper jaw 68 converges with lower jaw 40 toward the rear of the cutter head and near the rearward end of upper jaw 68 is a support plate 70, the lower end of which pivotally engages the rightward end of upper jaw 68 and the upper end of which pivotally engages a reaction block 72. Reaction block 72 is slidable in the guide means 74 and may be adjustably located between the guide members as by shims 76 inserted between the top of reaction member 72 and the top member 78 of the cutter head.

At the extreme rearward end of upper jaw 68, there is a rod 80 which is pivotally connected at the lower end to the rightward end of the upper jaw and which extends upwardly through an eye member 82 mounted on the frame of the cutter head and above which eye member there is a compression spring 84 bearing at the bottom on the eye member and at the upper end being confined by nut means 86 which are adjustable on rod 80.

At the rearward end of the cutter head and communicating with the space between the crusher jaws at the rightward end is a housing 88 which forms the connection previously referred to at 34.

When the cutter head is advanced into a formation, assuming that the operation being carried out is a dredging operation, earth and sand and the like will flow directly over base plate 36 and into housing 88. Rocks and boulders larger than the smallest distance between pressure jaws 40 and 68 will, however, be broken by the action of the crusher jaws and will only pass into housing 88 when the fragments thereof are small enough to escape from between the pressure jaws.

Figures 5, 6:
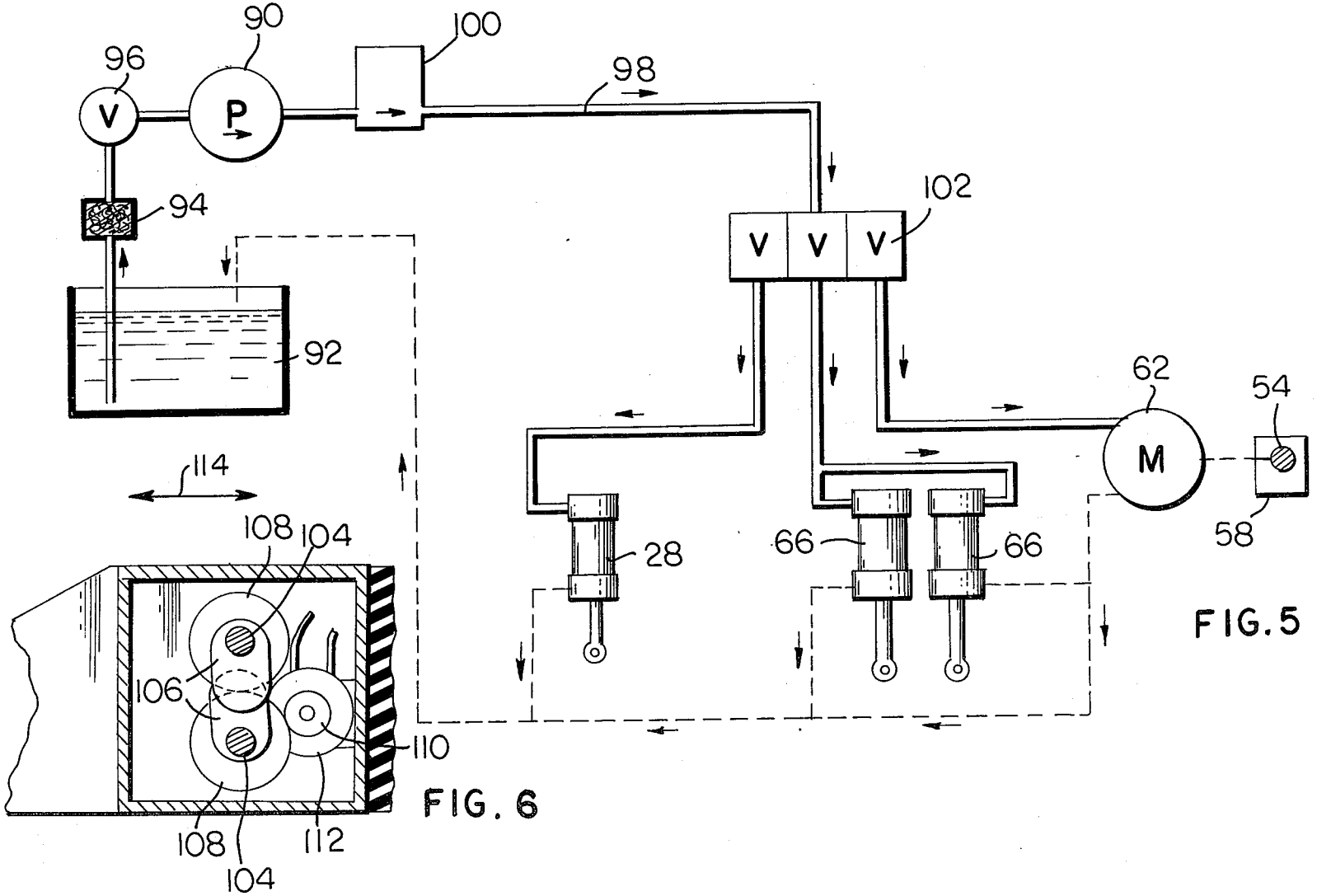
FIG. 5 is a schematic hydraulic circuit for actuation of the device.
FIG. 6 is a fragmentary view showing a different type of vibrator mechanism in which the force imparted to the cutting edge is always in the fore and aft direction.

The device as described can be fairly simply controlled as by the hydraulic circuit shown in FIG. 5. In FIG. 5, a hydraulic pump 90 draws fluid from a reservoir 92 via a filter 94 and a control valve 96 and discharges the fluid to a conduit 98 which includes connected therein an accumulator 100.

Valve 96 is connected to a valve mechanism 102 which can be operated to control the supply of fluid to the tilt cylinder or cylinders 28 thereby to control the attitude of the digging head where it engages the earth formation being worked.

Valve 102 also controls the supply of fluid to the cylinders 66 which oscillate the upper crusher jaw. Still further, valve 102 controls the fluid flow to fluid motor 62 connected to the vibrator mechanism referred to.

As to the vibrator mechanism, the modification shown in FIG. 6 has a pair of vibrator shafts 104 each with an eccentric weight 106 thereon. The shafts are geared together by gears 108 to rotate in opposite directions and are driven by a gear 110 which, in turn, is driven by a hydraulic motor 112 similar to the aforementioned hydraulic motor 62.

The vibrator arrangement of FIG. 6 provides that the forces established by the vibrator will always be in the fore and aft direction as indicated by arrow 114 thereby enhancing the efficiency with which the vibrator drives the cutting edge into the earth formation being worked.

As mentioned, the material removed during operation of the cutter head can be discarded as refuse or it can be further treated to remove sand therefrom or treated further to reduce the size of the rocks therein thereby to form an aggregate that can be used for fill or for concrete or the like.

From the foregoing, it will be appreciated that the device according to the present invention, while being similar to an excavating bucket, is also quite similar to a specially constructed crushing device with the fixed jaw provided with a vibratory cutting edge at the left side of the crusher structure toward which the crusher jaws diverge.

In either case, excavation work is simplified and speeded up so that it can be carried out at reduced cost. The arrangement according to the present invention, it will be evident, is particularly useful in dredging operations because the water flow provided for continuously removes the material taken through the crusher while the crusher simultaneously reduces large rocks and boulders to a size which can be handled by flowing the material through a conduit in a suitably constructed pump.

Modifications may be made within the scope of the appended claims.

What is claimed is:

1. In an earthworking device comprising in combination, an excavatig bucket having a vibrating cutting head, said bucket having a bottom wall extending in the fore and aft direction and open on the forward end, said vibrating cutting head extending across the bottom edge of the bucket at the forward end, support means for connecting the cutting head to the bucket for vibratory movement of the cutting head with respect to the bucket, a vibrator connected to the cutting head and operable for vibrating the cutting head to facilitate penetration of the cutting head into an earth formation, said bucket having a top wall extending in the fore and aft direction, said bottom wall and said top wall being in the form of jaw members, said top wall being oscillatable toward and away from the bottom wall for crushing boulders, said top wall converging with said lower wall in the rearward direction, and said bucket having a rearward opening for removing material including any crushed boulders from the bucket.

2. An earthworking device according to claim 1 in which said cutting head tapers downwardly in the forward direction and said vibrator is connected to the rearward end of said edge member.

3. An earthworking device according to claim 1 in which said edge cutting head downwardly in the forward direction and said vibrator is connected to the rearward end of said cutting head, said support means including a rubber-like cushion member interposed between the rearward side of said vibrator and the bottom wall of said bucket.

4. An earthworking device according to claim 1 in which the opposed faces of the said top and bottom walls of the bucket are provided with wear resistant plates.

5. An earthworking device according to claim 1 in which said bucket comprises means swingably supporting the rearward end of said top wall, actuating means carried by the bucket and connected to said top wall near the forward end thereof for swinging said top wall toward and away from said bottom wall to reduce boulders which enter said bucket, and conduit means connected to the bucket and communicating with space between the rearward ends of said top and bottom walls of the bucket for withdrawing excavated material from the bucket.

6. An earthworking device according to claim 5 in which said actuating means comprises a shaft rotatably supported in the bucket, eccentric means on the shaft engaging said top wall near the forward end thereof, and fluid motor means connected to said shaft for rotational movement of the shaft to actuate said top wall toward and away from said bottom wall.

7. An earthworking device according to claim 5 in which said conduit means includes a housing member mounted on the rearward side of the bucket and a conduit leading from the housing member and adapted to be connected to a source of suction.

8. An earthworking device according to claim 1 which includes power operated means connected to the forward end of said upper top wall for actuating said upper top wall in oscillation toward and away from the lower jaw wall.

9. An earthworking device according to claim 1 which includes means adjustably supporting the rearward end of said top wall for adjustment of the gap between said jaws at the rearward ends thereof.

10. An earthworking device according to claim 1 in which said vibrator comprises a housing extending in the transverse direction at the rear of said edge member, a shaft rotatable in the housing, eccentric weight means on the shaft, and a motor for driving the shaft in rotation.

11. An earthworking device according to claim 1 in which said vibrator comprises a housing extending in the transverse direction at the rear of said edge member, a pair of parallel shafts rotatable in the housing and each having eccentric weight means thereon, and a motor for driving said shafts in rotation in unison, said weight means being so disposed on said shafts that the unbalanced forces established thereby when the shafts rotate are substantially parallel to said lower jaw.

12. An earthworking device according to claim 1 which includes first fluid motor means connected to said crusher for bodily movement thereof, second fluid motor means connected to said upper jaw for effecting the said oscillating thereof, third fluid motor means connected for driving said vibrator, a source of fluid under pressure, and control valve means connected between said source and said fluid motors.

13. A method of working earth formations, especially formations containing rocks and boulders, which comprises; presenting a crusher excavating bucket having a cutting edge, a bottom wall and top wall, to a formation, vibrating the cutting edge while advancing it into the formation, receiving the material dislodged by the vibrating cutting edge between the bottom wall and top wall of the bucket, oscillating the the top wall relative to the bottom wall to crush any boulders in the dislodged material which are greater than a predetermined size, and withdrawing the dislodged material including any crushed boulders therein from the side of the crusher which is opposite the cutting edge.

14. The method according to claim 13 which includes moving water over the cutting edge and through the crusher to convey the dislodged material.

* * * * *

UNITED STATES PATENT AND TRADEMARK OFFICE

CERTIFICATE OF CORRECTION

PATENT NO. : 3,959,897

DATED : June 1, 1976

INVENTOR(S) : William P. May

It is certified that error appears in the above-identified patent and that said Letters Patent are hereby corrected as shown below:

Abstract, line 13, "he" should be --- the ---

Col. 2, line 43, "and" omitted between "16" and "cable"

Col. 2, line 44, "and" should be deleted

Col. 4, line 56 (Claim 1) "excavatig" should be --- excavating ---

Col. 6, line 1, (Claim 8) "upper" should be deleted

Col. 6, line 2, (Claim 8) "jaw" should be deleted.

Signed and Sealed this

Thirty-first Day of August 1976

[SEAL]

*Attest:*

RUTH C. MASON
*Attesting Officer*

C. MARSHALL DANN
*Commissioner of Patents and Trademarks*